US010016885B2

(12) United States Patent
Ookubo

(10) Patent No.: US 10,016,885 B2
(45) Date of Patent: Jul. 10, 2018

(54) IMPACT TOOL

(71) Applicant: HITACHI KOKI CO., LTD., Tokyo (JP)

(72) Inventor: Takahiro Ookubo, Hitachinaka (JP)

(73) Assignee: HITACHI KOKI CO., LTD., Tokyo (JP)

( * ) Notice: Subject to any disclaimer, the term of this patent is extended or adjusted under 35 U.S.C. 154(b) by 498 days.

(21) Appl. No.: 14/772,722

(22) PCT Filed: Feb. 17, 2014

(86) PCT No.: PCT/JP2014/000799
§ 371 (c)(1),
(2) Date: Sep. 3, 2015

(87) PCT Pub. No.: WO2014/155943
PCT Pub. Date: Oct. 2, 2014

(65) Prior Publication Data

US 2016/0151904 A1 Jun. 2, 2016

(30) Foreign Application Priority Data

Mar. 29, 2013 (JP) ..... 2013-072328

(51) Int. Cl.
*B25D 16/00* (2006.01)
*B25D 11/12* (2006.01)
(Continued)

(52) U.S. Cl.
CPC ..... *B25D 16/00* (2013.01); *B25D 11/12* (2013.01); *B25D 17/20* (2013.01); *B25D 17/26* (2013.01);
(Continued)

(58) Field of Classification Search
CPC ..... B25D 16/00; B25D 11/12; B25D 17/20; B25D 17/26; B25D 2217/0096;
(Continued)

(56) References Cited

U.S. PATENT DOCUMENTS

2002/0050365 A1 5/2002 Bongers-Ambrosius et al.
2005/0224243 A1 10/2005 Baumann et al.

FOREIGN PATENT DOCUMENTS

CN 1332064 A 1/2002
DE 2918629 A1 11/1980
JP 2005-40880 A 2/2005

OTHER PUBLICATIONS

International Search Report & Written Opinion of the International Searching Authority PCT/JP2014/000799 dated Mar. 28, 2014.
(Continued)

*Primary Examiner* — Michelle Lopez
(74) *Attorney, Agent, or Firm* — McDermott Will & Emery LLP

(57) ABSTRACT

An impact tool which transmits an impact force to a tool bit supported by a casing includes: a cylinder which is attached to the casing and has an opening on one end side thereof to which the tool bit is inserted; an intermediate element which is provided in an inside of the cylinder so as to be able to move straight, has a projection projecting in a radial direction so as to regulate a range of the straight movement, and transmits the impact force to the tool bit; and passages and which communicate a space in an inside of the cylinder at a position nearer to the tool bit than the projection with the outside of the cylinder and penetrate through the cylinder in the radial direction.

6 Claims, 3 Drawing Sheets

(51) Int. Cl.
*B25D 17/20* (2006.01)
*B25D 17/26* (2006.01)

(52) U.S. Cl.
CPC ..... *B25D 2217/0096* (2013.01); *B25D 2250/131* (2013.01); *B25D 2250/231* (2013.01); *B25D 2250/365* (2013.01)

(58) Field of Classification Search
CPC ..... B25D 2250/131; B25D 2250/231; B25D 2250/365
USPC ..... 173/104
See application file for complete search history.

(56) References Cited

OTHER PUBLICATIONS

Office Action issued in corresponding Chinese Patent Application No. 201480012626.2 dated Sep. 2, 2016, with English language translation.

IMPACT TOOL

CROSS-REFERENCE TO RELATED APPLICATIONS

This Application is the U.S. National Phase of PCT/JP2014/000799 filed Feb. 17, 2014, which claims priority to Japanese Patent Application No. 2013-072328 filed Mar. 29, 2013. The subject matter of each is incorporated herein by reference in entirety.

TECHNICAL FIELD

The present invention relates to an impact tool capable of applying an impact force to a tool bit like a hammer or a hammer drill.

BACKGROUND ART

Conventionally, impact tools such as a hammer and a hammer drill are able to apply an impact force to a tool bit. Patent Literature 1 describes an example of the impact tool. The impact tool described in Patent Literature 1 has a hollow casing, an electric motor provided in the inside of the casing, an intermediate shaft to which a rotational force of the electric motor is transmitted via a first gear train, a hollow cylinder to which a rotational force of the intermediate shaft is transmitted via a second gear train, and a tool bit attached to the cylinder.

In addition, a piston which is movable in a center line direction of the cylinder is provided. The piston has a cylindrical shape, and an impact element is inserted in the inside of the piston. Moreover, in the inside of the cylinder, an intermediate element serving as an impact force transmitting member is provided. In addition, the piston, the intermediate element and the tool bit are disposed coaxially, and the intermediate element is disposed between the piston and the tool bit in a direction along the center line. Then, a pneumatic chamber is formed between a bottom part of the piston and the impact element.

On the other hand, a driving force conversion mechanism is provided in the inside of the casing. The driving force conversion mechanism converts the rotational force of the intermediate shaft into a reciprocating force of the piston. Moreover, a clutch mechanism is provided in the inside of the casing. The clutch mechanism transmits the driving force of the intermediate shaft to the driving force conversion mechanism or cuts off the driving force based on an operation of a change lever.

In the impact tool described in Patent Literature 1, the rotational force of the electric motor is transmitted to the cylinder via the first gear train, the intermediate shaft and the second gear train, and the cylinder is rotated. The rotational force of the cylinder is transmitted to the tool bit, and the tool bit is rotated. In addition, when the change lever has been operated and the clutch mechanism has been turned-off, the driving force of the intermediate shaft is not transmitted to the piston. Consequently, the impact force is not applied to the impact element.

Meanwhile, when the change lever has been operated and the clutch mechanism has been turned-on, the rotational force of the intermediate shaft is converted into the reciprocating force of the piston by the driving force conversion mechanism. Then, the air pressure in the pneumatic chamber repeats up and down alternately, and the impact force is transmitted to the intermediate element. When the tool bit is pressed against a machining object, since the tool bit and the intermediate element are in contact with each other, the impact force transmitted to the intermediate element is transmitted to the tool bit. In this way, the impact force is applied to the tool bit while the tool bit is being rotated.

On the other hand, grease as a lubricant is enclosed in the inside of the casing, and the grease lubricates lubrication object parts such as the first gear train, the second gear train and the driving force conversion mechanism. In addition, when the use of the impact tool is interrupted or terminated after the operation of the impact tool is finished, the tool bit is made to be separated from the machining object.

CITATION LIST

Patent Literature

PTL 1: Japanese Patent Application Laid-Open Publication No. 2005-40880

SUMMARY OF INVENTION

Technical Problem

Incidentally, when the tool bit which is directed downward is separated from a machining object, the tool bit descends in the inside of the cylinder due to the own weight, and stops at a prescribed position. On the other hand, as for the impact tool, temperature in the casing rises due to friction between the cylinder and the piston, meshing resistance between the first gear train and the second gear train, and others. As for the grease, the viscosity is decreased when the temperature rises, and there is a possibility that a part of the grease enters between the cylinder and the intermediate element through a gap between the cylinder and the piston. In addition, there is also a possibility that air enters between the cylinder and the intermediate element due to the operation of the piston.

When the air and grease are accumulated between the cylinder and the intermediate element as described above, descending operation of the intermediate element is inhibited even when the tool bit is made to be separated from the machining object. As a result, clearance is formed between the tool bit and the intermediate element, which causes a problem of an occurrence of a so-called idle impact in which the intermediate element is impacted in the state where the clearance is formed between the tool bit and the intermediate element.

An object of the present invention is to provide an impact tool capable of preventing the idle impact of the impact force transmitting member.

Solution to Problem

An impact tool according to an embodiment of the present invention is an impact tool which transmits an impact force to a tool bit supported by a tool body, and the impact tool includes: a cylinder member which is attached to the tool body and has an opening on one end side thereof to which the tool bit is inserted; an impact force transmitting member which is provided in an inside of the cylinder member so as to be able to move straight, has a projection projecting in a radial direction so as to regulate a range of the straight movement, and transmits the impact force to the tool bit; and a passage which communicates the inside of the cylinder member at a position nearer to the tool bit than the projection in a direction of the straight movement of the impact force transmitting member with an outside of the cylinder member, and penetrates through the cylinder member in a radial direction.

Advantageous Effects of Invention

According to the present invention, foreign objects which exist between a cylinder member and an impact force transmitting member are discharged to an outside of the cylinder member via a passage. Therefore, movement of the impact force transmitting member is prevented from being inhibited, and the idle impact can be prevented.

DESCRIPTION OF EMBODIMENTS

Figure 1:
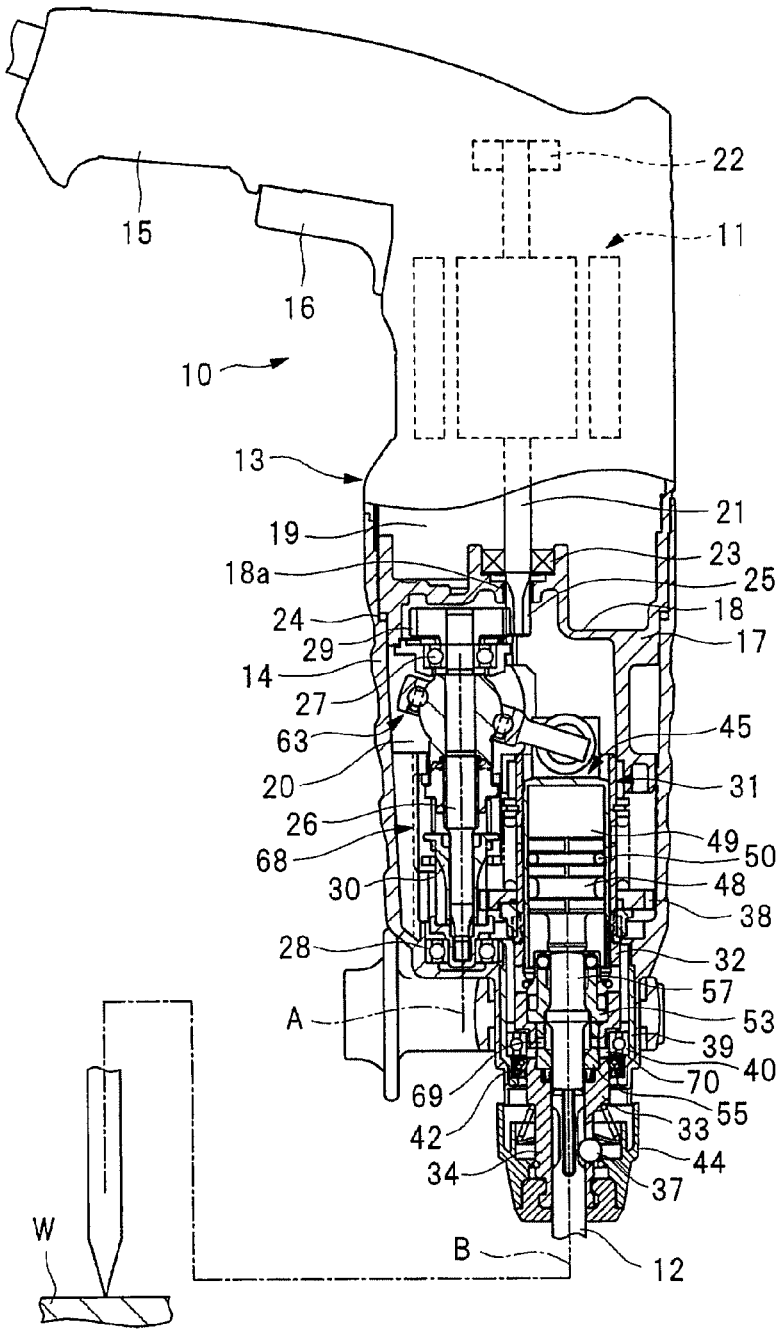
FIG. 1 is a sectional view showing an impact tool of the present invention.
Figure 2:
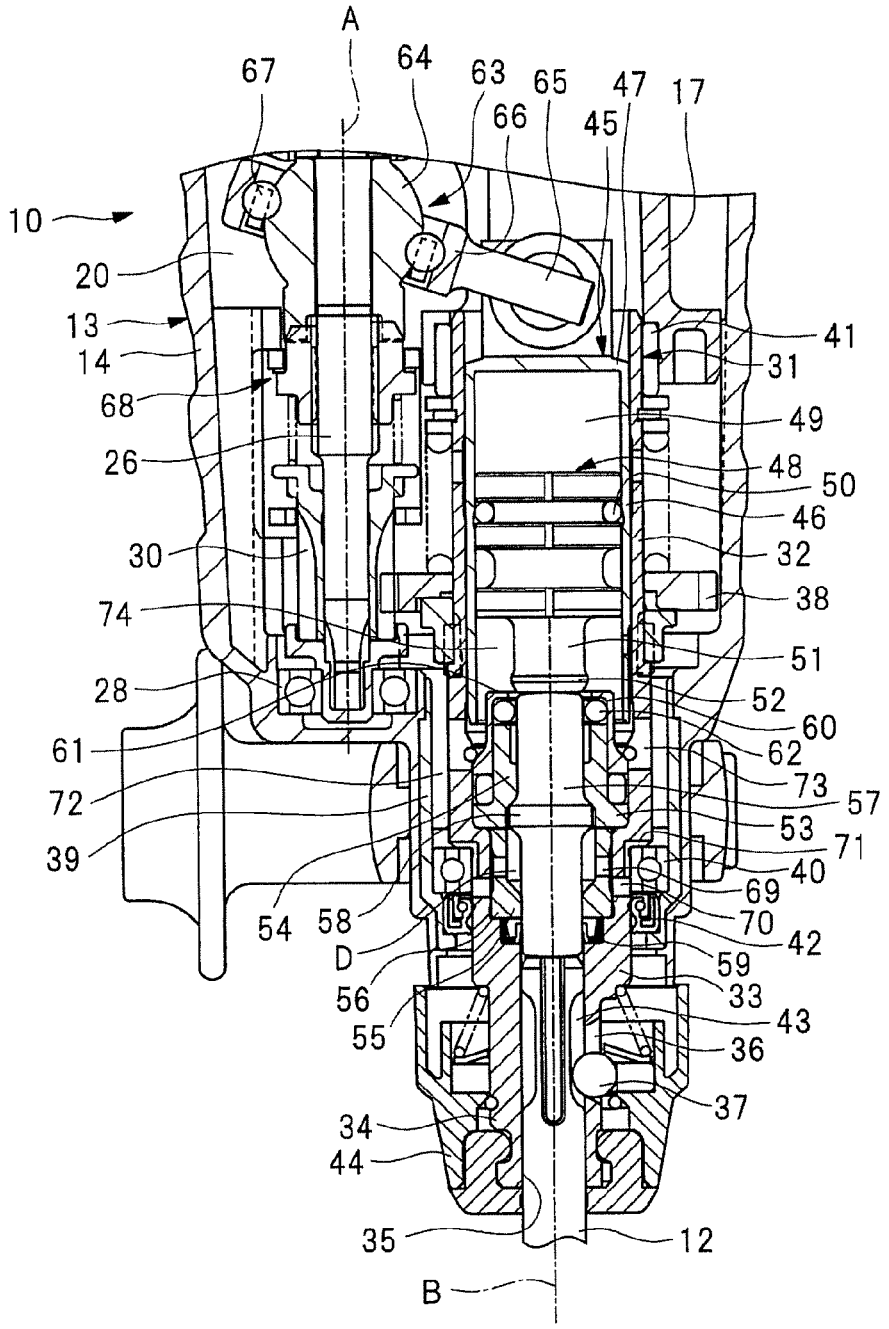
FIG. 2 is a sectional view showing a principal part of the impact tool shown in FIG. 1 in an enlarged manner.

Hereinafter, an embodiment of the present invention will be described in detail with reference to FIGS. 1 to 3. An impact tool 10 is a hammer drill. More specifically, the impact tool 10 has a function of transmitting a rotational force of an electric motor 11 to a tool bit 12 to rotate the tool bit 12 and a function of converting the rotational force of the electric motor 11 into a driving force in a linear direction to impact the tool bit 12 by the driving force. The tool bit 12 includes a drill bit applying a process to a machining object W such as concrete, stone or the like. Here, the process includes drilling, boring or the like. The impact tool 10 has a casing 13 as a tool body, and the casing 13 has a cylindrical body part 14 and a grip 15 continuous with one end of the body part 14. A trigger switch 16 is provided on the grip 15.

An inner cover 17 is provided in the inside of the body part 14. The inner cover 17 is provided with a flange 18 extended toward an inner side in a radial direction. The inside of the body part 14 is partitioned by the flange 18 into a first storage chamber 19 and a second storage chamber 20. The second storage chamber 20 corresponds to the storage chamber of the present invention.

The electric motor 11 is provided in the first storage chamber 19. The electric motor 11 has a rotation shaft 21, and the rotation shaft 21 is rotatably supported by bearings 22 and 23. The bearing 23 at one end is provided in the flange 18. This bearing 23 is a sealed bearing provided with a sealant, and the bearing 23 separates fluid-tightly the first storage chamber 19 and the second storage chamber 20. In addition, the inner cover 17 has a cylindrical shape, and an O-ring 24 as a sealant is interposed between the inner cover 17 and the body part 14.

A driving gear 25 is formed on an outer circumferential surface of the rotation shaft 21, and the driving gear 25 is disposed in the second storage chamber 20. An intermediate shaft 26 is provided in the second storage chamber 20. This intermediate shaft 26 is a driving force transmitting element which transmits the driving force of the rotation shaft 21 to the tool bit 12. Two bearings 27 and 28 are coaxially provided in the second storage chamber 20, and the intermediate shaft 26 is rotatably supported by the two bearings 27 and 28 about a center line A. A driven gear 29 fixed to the intermediate shaft 26 is provided, and the driven gear 29 is meshed with the driving gear 25. In addition, a gear 30 is attached to the intermediate shaft 26. The gear 30 is able to be switched between a state where the gear 30 is integrally rotated with the intermediate shaft 26 and a state where the gear 30 is relatively rotated with the intermediate shaft 26.

Moreover, a cylinder 31 having a cylindrical shape is provided across the range from the inside of the casing 13 to the outside thereof. An opening on one end side of the cylinder 31 is disposed in the outside of the casing 13, and an opening on the other end side of the cylinder 31 is disposed in the second storage chamber 20. This cylinder 31 is an element which transmits a rotational force of the intermediate shaft 26 to the tool bit 12. The cylinder 31 has a large diameter cylindrical part 32, a middle diameter cylindrical part 33 and a small diameter cylindrical part 34 which are provided coaxially about a center line B. An inner diameter of the large diameter cylindrical part 32 is larger than an inner diameter of the middle diameter cylindrical part 33, and the inner diameter of the middle diameter cylindrical part 33 is larger than an inner diameter of the small diameter cylindrical part 34.

A tool support hole 35 is provided in the small diameter cylindrical part 34, and a holding hole 36 penetrating through the small diameter cylindrical part 34 in a radial direction is provided. A ball 37 is held in the holding hole 36. In addition, a gear 38 is attached to the outer circumference of the large diameter cylindrical part 32. The gear 38 is provided so as to rotate integrally with the cylinder 31, and the gear 38 is meshed with the gear 30. The gear 38 and the gear 30 are a gear train which transmits the rotational force of the intermediate shaft 26 to the cylinder 31.

A sleeve 39 having a cylindrical shape is fixed to the inside of the body part 14. The sleeve 39 is provided in the outside of the cylinder 31, and the sleeve 39 is provided coaxially with the cylinder 31. A bearing 40 is interposed between the inner circumferential surface of the sleeve 39 and the outer circumferential surface of the middle diameter cylindrical part 33. A bearing 41 is interposed between the outer circumferential surface of the large diameter cylindrical part 32 and the inner circumferential surface of the inner cover 17. The cylinder 31 is rotatably supported by two bearings 40 and 41.

A sealing device 42 is provided between the sleeve 39 and the middle diameter cylindrical part 33. This sealing device 42 is constituted by a heretofore known oil seal or the like, and the sealing device 42 prevents a lubricant enclosed in the second storage chamber 20 from leaking to the outside of the casing 13. The sealing device 42 is disposed between the bearing 40 and the small diameter cylindrical part 34 in a direction along the center line B.

An opening on one end side of the small diameter cylindrical part 34 is disposed in the outside of the casing 13. More specifically, the small diameter cylindrical part 34 is disposed in the outside of the casing 13, and the tool support hole 35 is formed in the small diameter cylindrical part 34. The tool bit 12 is inserted in the tool support hole 35. A groove 43 is provided on the outer circumference of the tool bit 12 in the direction along the center line B, and the ball 37 can roll along the groove 43. An end cover 44 is attached to the outer circumference of the small diameter cylindrical part 34. In addition, the tool bit 12 can move within the range of the length of the groove 43 in the direction along the center line B in a state where the tool bit 12 is inserted in the tool support hole 35. Also, the ball 37 is engaged with the tool bit 12 and the small diameter cylindrical part 34, and the tool bit 12 can rotate integrally with the cylinder 31. The tool bit 12 can be attached and detached to and from the small diameter cylindrical part 34 by operating the end cover 44.

A piston 45 is inserted in the large diameter cylindrical part 32. The piston 45 is able to move reciprocally in the direction along the center line B in the inside of the large diameter cylindrical part 32. This piston 45 has a cylindrical part 46 and a bottom part 47 formed to be continuous with the cylindrical part 46. An opening part of the cylindrical part 46 is disposed on a middle diameter cylindrical part 33 side. An impact element 48 is inserted in the cylindrical part 46. The impact element 48 is movable in the direction along the center line B with respect to the piston 45, and a pneumatic chamber 49 is formed between the impact element 48 and the bottom part 47 in the inside of the cylindrical part 46.

An O-ring 50 is attached to the outer circumferential surface of the impact element 48, and the O-ring 50 keeps air-tightness between the impact element 48 and the cylindrical part 46. A shaft part 51 is provided in a part on the opposite side of the pneumatic chamber 49 in the impact element 48, and an annular projection 52 is provided on the outer circumference of the shaft part 51.

A regulation member 53 is provided in the inside of the large diameter cylindrical part 32. The regulation member 53 has a cylindrical shape which surrounds the center line B, and a projection 54 is provided on the inner circumference of the regulation member 53. The projection 54 is formed in an annular shape which surrounds the center line B. In addition, a regulation member 55 is provided in the inside of the middle diameter cylindrical part 33. The regulation member 55 corresponds to a support member of the present invention. The regulation member 55 has a cylindrical shape which surrounds the center line B, and a projection 56 is provided on the inner circumference of the regulation member 55. The projection 56 is formed in an annular shape which surrounds the center line B. The regulation members 53 and 55 regulate the range in which an intermediate element 57 moves straight in the direction along the center line B. In addition, the cylinder 31 and the regulation members 53 and 55 correspond to a cylinder member of the present invention.

The shaft-like intermediate element 57 is provided across the inside of the two regulation members 53 and 55. The intermediate element 57 corresponds to an impact force transmitting member of the present invention. The intermediate element 57 is integrally made of a metallic material, and the intermediate element 57 is disposed between the impact element 48 and the tool bit 12 in the direction along the center line B. The intermediate element 57 can move straight in the direction along the center line B, and a projection 58 is provided on the outer circumference of the intermediate element 57. The projection 58 projects toward an outer side in a radial direction about the center line B. The projection 58 is disposed between the projection 54 and the projection 56 in the direction along the center line B. An outer diameter of the projection 58 is larger than an inner diameter of the projection 54 and an inner diameter of the projection 56. The intermediate element 57, the impact element 48 and the tool bit 12 are disposed coaxially about the center line B.

Moreover, a sealing device 59 is attached between an inner surface of the middle diameter cylindrical part 33 and an outer surface of the intermediate element 57. The sealing device 59 is constituted by an oil seal or the like and the sealing device 59 provides a fluid-tight seal between the inner circumferential surface of the cylinder 31 and the outer circumferential surface of the intermediate element 57.

The sealing device 59 corresponds to the sealing device of the present invention. The sealing device 59 is provided at a position in contact with the outer circumferential surface of the intermediate element 57 irrespective of a position of the intermediate element 57 moving straight in the direction along the center line B. The sealing device 59 comes into contact with the outer circumferential surface of the intermediate element 57 at a position nearer to the tool bit 12 than the projection 58. More specifically, the sealing device 59 comes into contact with the outer circumferential surface of the intermediate element 57 between the projection 58 and the tool bit 12 in the direction along the center line B.

Moreover, a holding member 60 is attached to an inner circumference of the large diameter cylindrical part 32. The holding member 60 and the two regulation members 53 and 55 are fixed so as not to move in the direction along the center line B. The holding member 60 is formed in an annular shape which surrounds the center line B, and an inward flange 61 is provided on the holding member 60. The inward flange 61 is disposed at a part nearer to the impact element 48 than the regulation member 53 in the direction along the center line B. A retainer 62 is attached between the inward flange 61 and the regulation member 53. The retainer 62 is integrally made of an annular rubber material, and an inner diameter of the retainer 62 is smaller than an outer diameter of the projection 52.

On the other hand, a driving force conversion mechanism 63 is provided in the second storage chamber 20. The driving force conversion mechanism 63 converts the rotational force of the intermediate shaft 26 into a reciprocating force of the piston 45. The driving force conversion mechanism 63 has an inner ring 64 attached to an outer circumference of the intermediate shaft 26, an outer ring 66 having a coupling rod 65, and a rolling element 67 interposed between the inner ring 64 and the outer ring 66. The inner ring 64 is attached so as to be relatively rotatable with respect to the intermediate shaft 26. In addition, the coupling rod 65 is connected to the bottom part 47 of the piston 45.

Moreover, a clutch mechanism 68 is provided in the second storage chamber 20. This clutch mechanism 68 connects or cuts off a driving force transmitting path between the inner ring 64 and the intermediate shaft 26. In addition, the clutch mechanism 68 connects or cuts off a driving force transmitting path between the gear 30 and the intermediate shaft 26. When a worker operates a mode changeover switch, the clutch mechanism 68 is activated. The mode changeover switch is provided on an outer surface of the casing 13.

In the second storage chamber 20, grease as a lubricant is enclosed. The grease lubricates a meshing part between the driving gear 25 and the driven gear 29, a meshing part between the gears 30 and 38, a slide part of the driving force conversion mechanism 63, and the like.

Next, a characteristic configuration of the present invention will be described. A space D is formed between the inner circumferential surface of the regulation member 55 and the outer circumferential surface of the intermediate element 57. This space D is formed between the projection 56 and the projection 58 in the direction along the center line B. The space D enables the projection 58 of the intermediate element 57 to move in the direction along the center line B.

In addition, a passage 69 penetrating through the regulation member 55 in a radial direction is provided. The passage 69 is communicated with the space D. The space D corresponds to the inside of the cylinder member in the present invention, and the passage 69 corresponds to a first passage of the present invention.

Moreover, a passage 70 penetrating through the middle diameter cylindrical part 33 in a radial direction is provided.

The passage 70 is communicated with the passage 69. In this manner, the passages 69 and 70 communicate the space D formed at a position nearer to the tool bit 12 than the projection 58 in a direction of the straight movement of the intermediate element 57 with the outside of the cylinder 31.

In addition, a groove 71 is provided on the outer circumferential surface of the middle diameter cylindrical part 33. The groove 71 is connected to the passage 70, and is bent into an L shape within a plane including the center line B. The groove 71 is provided across the range from the inside of the bearing 40 to the side of the bearing 40. The passage 70 and the groove 71 constitute a crank shape as a whole in the cross section in the longitudinal direction of the cylinder 31. The passage 70 and the groove 71 correspond to a second passage of the present invention.

Moreover, a space 72 is formed between the outer circumferential surface of the large diameter cylindrical part 32 and the inner circumferential surface of the sleeve 39, and a passage 73 is communicated with the second storage chamber 20 via the space 72. Besides, the passage 73 penetrating through the large diameter cylindrical part 32 is formed, and the passage 73 is communicated with a space 74 between the piston 45 and the holding member 60. The driving force conversion mechanism 63, the driving gear 25, the driven gear 29, and the gears 30 and 38 correspond to a driving force transmitting mechanism of the present invention. The driving gear 25, the driven gear 29 and the gears 30 and 38 correspond to a first mechanism of the present invention, and the driving force conversion mechanism 63 corresponds to a second mechanism of the present invention.

An operation of the impact tool 10 will be described. First, a worker holds the impact tool 10 and presses the impact tool 10 against the machining object W with the center line B being approximately perpendicular and the tool bit 12 being directed downward. Then, the tool bit 12 is pushed in a direction approaching the regulation member 55, and the tool bit 12 and the intermediate element 57 move together, and the projection 58 comes into contact with the projection 54 as shown in FIG. 2, so that the tool bit 12 and the intermediate element 57 stop.

When a worker operates the trigger switch 16, electric power is supplied to the electric motor 11 to rotate the rotation shaft 21, and the rotational force of the rotation shaft 21 is transmitted to the intermediate shaft 26 via the driving gear 25 and the driven gear 29. When the mode changeover switch is operated and a drill mode is selected, the clutch mechanism 68 connects the intermediate shaft 26 and the gear 30 so as to be able to transmit the driving force and cuts off the driving force transmitting path between the intermediate shaft 26 and the inner ring 64. Consequently, the rotational force of the intermediate shaft 26 is transmitted to the cylinder 31 via the gear 30 and the gear 38. The rotational force of the cylinder 31 is transmitted to the tool bit 12, and the machining object W is cut or crushed by the tool bit 12. Note that, since the clutch mechanism 68 cuts off the driving force transmitting path between the intermediate shaft 26 and the inner ring 64, the rotational force of the intermediate shaft 26 is not converted into a linear motion force of the piston 45. Therefore, the impact force is not applied to the tool bit 12.

Meanwhile, when the mode changeover switch is operated and a hammer drill mode is selected, the clutch mechanism 68 connects the intermediate shaft 26 to both of the gear 30 and the inner ring 64 so as to be able to transmit the driving force. Then, the rotational force of the intermediate shaft 26 is transmitted to the tool bit 12, and the driving force conversion mechanism 63 converts the rotational force of the intermediate shaft 26 into the linear motion force of the piston 45.

When the piston 45 reciprocally moves, air pressure in the pneumatic chamber 49 repeats up and down alternately, and the impact force of the impact element 48 is transmitted to the tool bit 12 via the intermediate element 57. In this way, both of the rotational force and the impact force are applied to the tool bit 12. When the tool bit 12 is pressed against the machining object W while the impact element 48 is applying the impact force to the intermediate element 57, the intermediate element 57 does not move to the small diameter cylindrical part 34 side, and the projection 52 of the impact element 48 does not enter into the inside of the retainer 62.

Moreover, when the mode changeover switch is operated and a neutral mode is selected, by the operation of the clutch mechanism 68, the driving force transmitting path between the intermediate shaft 26 and the gear 30 is cut off, and the driving force transmitting path between the intermediate shaft 26 and the inner ring 64 is cut off. Therefore, the rotational force of the intermediate shaft 26 is not transmitted to the tool bit 12, and the rotational force of the intermediate shaft 26 is not converted into the linear motion force of the piston 45. Therefore, the tool bit 12 does not rotate, and the impact force is not transmitted to the tool bit 12, either. Besides, the grease of the second storage chamber 20 lubricates the meshing part between the driving gear 25 and the driven gear 29, the meshing part between the gears 30 and 38, the slide part of the driving force conversion mechanism 63 and the like.

Figure 3:
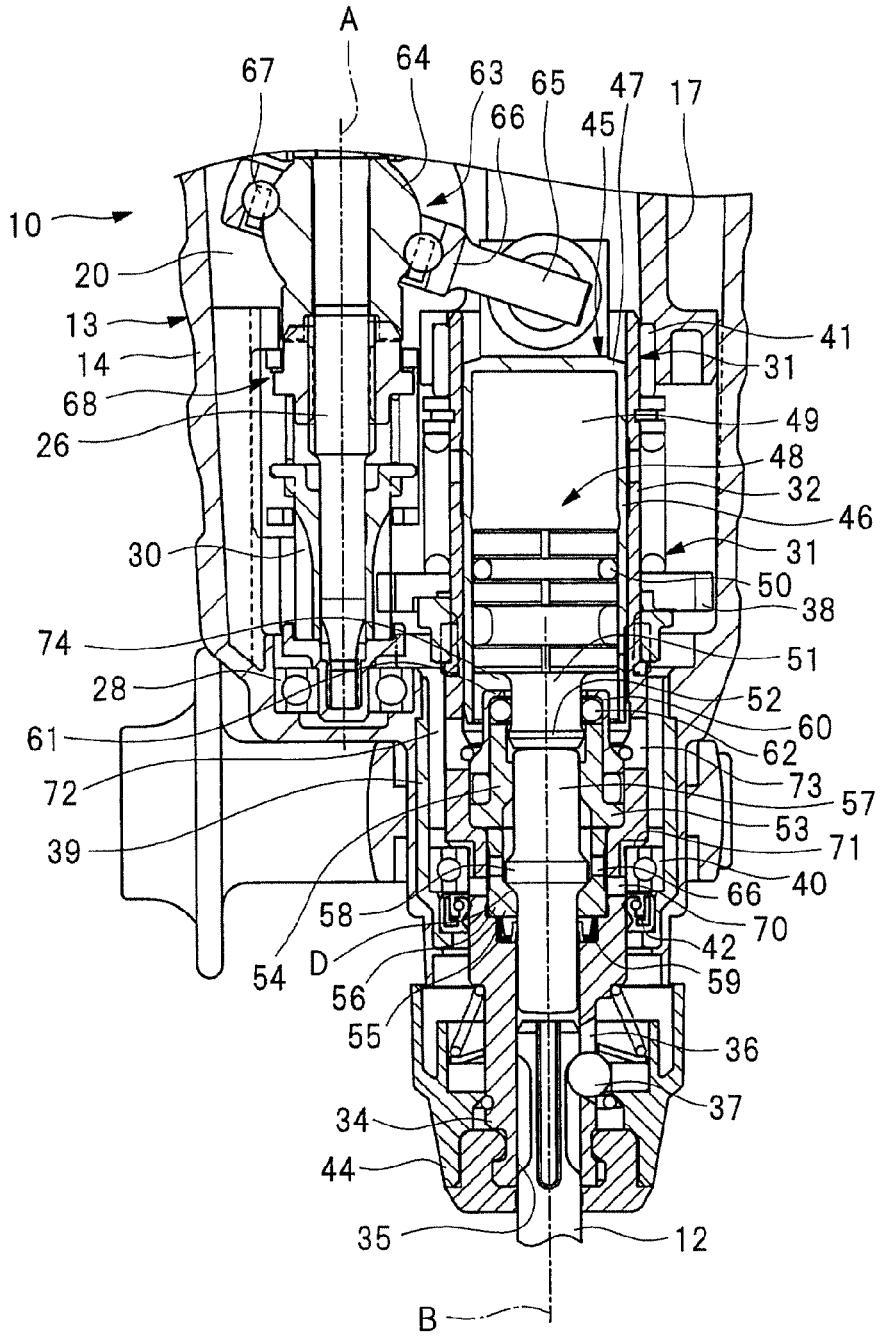
FIG. 3 is a sectional view showing a principal part of the impact tool shown in FIG. 1 in an enlarged manner.

On the other hand, when a worker lifts up the impact tool 10 after having used the impact tool 10, the tool bit 12 moves by the own weight in the inside of the tool support hole 35 and the ball 37 moves to the end part of the groove 43 as shown in FIG. 3, so that the tool bit 12 stops. Also, the intermediate element 57 also moves by the own weight or the air pressure of the pneumatic chamber 49 in a direction approaching the small diameter cylindrical part 34 and the projection 58 comes into contact with the projection 56, so that the intermediate element 57 stops. In this state, a clearance is formed between the intermediate element 57 and the tool bit 12. Moreover, when the impact force is applied to the impact element 48 in the state where the projection 58 and the projection 56 are in contact with each other and the intermediate element 57 stops, the projection 52 enters into the inside of the retainer 62, and the retainer 62 is elastically deformed.

In this manner, the projection 52 passes through the inside of the retainer 62, the shaft part 51 enters into the inside of the retainer 62, and the impact element 48 stops. Thereafter, even when the piston 45 repeats reciprocating movement, since the impact element 48 is stopped by an engagement force of the projection 52 and the retainer 62, the air pressure of the pneumatic chamber 49 does not rise. Therefore, it is possible to prevent the idle impact, that is, prevent the impact force from being applied to the intermediate element 57 in a state where the intermediate element 57 and tool bit 12 are not in contact with each other.

On the other hand, when the tool bit 12 is pressed against the machining object W in the state where the shaft part 51 enters into the inside of the retainer 62 and the impact element 48 stops, the intermediate element 57 moves in a direction approaching the pneumatic chamber 49. Then, the projection 52 passes through the inside of the retainer 62 and the projection 58 comes into contact with the projection 54, so that the intermediate element 57 stops. More specifically, it becomes possible to transmit the impact force of the impact element 48 to the tool bit 12. As mentioned above, the projection 58 regulates the range where the intermediate element 57 moves straight in the direction along the center line B.

By the way, a temperature in the second storage chamber 20 rises due to a heat generated in the meshing part between the driving gear 25 and the driven gear 29, the meshing part between the gears 30 and 38, the slide part of the driving force conversion mechanism 63 and the like. As a result, the viscosity of the grease decreases, and a part of the grease may enter into the space D through a gap between the cylinder 31 and the pistons 45, the inside of the retainer 62 and the inside of the regulation members 53 and 55. Even when the grease and the air in the space D pass through the inside of the projection 56, since the sealing device 59 is provided, it is possible to prevent the grease from leaking to the outside of the casing 13 via the tool support hole 35.

Next, an operation in the case where the grease and air are accumulated in the space D when the use of the impact tool 10 is stopped or finished will be described. When the tool bit 12 is separated from the machining object W by lifting up the impact tool 10, the tool bit 12 moves by the own weight in the tool support hole 35, and the ball 37 moves to the end part of the groove 43, so that the tool bit 12 stops. When the tool bit 12 has moved, the intermediate element 57 is also going to move by the own weight or the pressure of the pneumatic chamber 49 in the direction approaching the small diameter cylindrical part 34. Foreign objects such as the grease and air which are accumulated in the space D generate a resistance force which inhibits the intermediate element 57 from moving in the direction approaching the small diameter cylindrical part 34.

Meanwhile, in the present embodiment, the space D is communicated with the second storage chamber 20 via the passages 69 and 70, the groove 71 and the space 72. Therefore, in a state where the passage 69 is located on the side nearer to the tool bit 12 than the projection 58 in the direction along the center line B, the grease and air in the space D can be discharged via these paths to the second storage chamber 20. More specifically, the operation in which the intermediate element 57 moves by the own weight or the pressure of the pneumatic chamber 49 in the direction approaching the small diameter cylindrical part 34 is not inhibited and the projection 58 comes into contact with the projection 56, so that the intermediate element 57 stops. In this state, even when the impact element 48 moves and comes into contact with the intermediate element 57, the impact force is low, and it is possible to prevent the idle impact in the same way as mentioned above.

In addition, the passage 70 and the groove 71 through which the air pressure and grease in the space D are let out to the second storage chamber 20 have a crank shape as a whole, and are formed in a labyrinth structure. Therefore, it is possible to prevent the grease in the second storage chamber 20 from flowing backward to the space D through the groove 71 and the passage 70. Moreover, the resistance force which inhibits the intermediate element 57 from moving in the direction approaching the small diameter cylindrical part 34 is small. Therefore, the intermediate element 57 is not inhibited from moving in the direction approaching the small diameter cylindrical part 34, and it is not needed to increase the weight of the intermediate element 57 itself. Consequently, it is possible to achieve the weight reduction of the intermediate element 57 and shorten the length of the intermediate element 57 in the direction of the center line B.

In addition, the sealing device 42 prevents the grease passing through the passage 70 and the groove 71 from leaking from a gap between the sleeve 39 and the middle diameter cylindrical part 33 to the outside of the casing 13. Moreover, the bearing 23 having a sealant prevents the grease in the second storage chamber 20 from leaking to the first storage chamber 19 through a shaft hole **18*a* of the flange 18. Moreover, the O-ring 24 prevents the grease in the second storage chamber 20 from leaking through a gap between the inner cover 17 and the casings 13**.

It goes without saying that the present invention is not limited to the foregoing embodiments and various modifications and alterations can be made within the scope of the present invention. For example, in the above-mentioned embodiment, any impact tool 10 can be applied as long as it can apply an impact force to a tool bit, and the impact tool 10 may be a hammer which is not able to rotate the tool bit. In addition, the tool bit may be a driver bit for fastening a screw member. Moreover, the tool bit and further the impact tool 10 can be used in any of the states where the center line A and the center line B are along a perpendicular direction, along a horizontal direction, and along a direction between the horizontal direction and the perpendicular direction.

INDUSTRIAL APPLICABILITY

The present invention can be applied to an impact tool capable of applying an impact force to a tool bit like a hammer or a hammer drill.

The invention claimed is:

1. An impact tool which transmits an impact force to a tool bit supported by a tool body, comprising:

a cylinder member which is attached to the tool body and has an opening on one end side thereof to which the tool bit is inserted;

an impact force transmitting member which is provided in an inside of the cylinder member so as to be able to move straight, has a projection projecting in a radial direction so as to regulate a range of the straight movement, and transmits the impact force to the tool bit; and a passage which communicates the inside of the cylinder member at a position nearer to the tool bit than the projection in a direction of the straight movement of the impact force transmitting member with an outside of the cylinder member, and penetrates through the cylinder member in a radial direction.

2. The impact tool according to claim 1, wherein in an inside of the tool body, a driving force transmitting mechanism which is lubricated with a lubricant, and a storage chamber in which the driving force transmitting mechanism is stored and with which an opening on the other end side of the cylinder member is communicated are provided, and the outside of the cylinder member is connected with the storage chamber.

3. The impact tool according to claim 2 comprising:

a piston provided in the inside of the cylinder member so as to be able to move reciprocally; and an impact element which is provided in the inside of the cylinder member and applies an impact force generated by the reciprocating movement of the piston to the impact force transmitting member, wherein the driving force transmitting mechanism includes a first mechanism which transmits a rotational force of an electric motor to the cylinder member and a second mechanism which converts the rotational force of the electric motor into a reciprocating force of the piston, and the cylinder member and the tool bit are connected so as to be able to rotate integrally.

4. The impact tool according to claim 2, wherein a sealing device which inhibits the lubricant from leaking from the opening on one end side of the cylinder member is provided at a position nearer to the tool bit than the projection in a direction of the straight movement of the impact force transmitting member.

5. The impact tool according to claim 4, wherein the sealing device comes into contact with an outer circumferential surface of the impact force transmitting member at a position nearer to the tool bit than the projection irrespective of a position of the straight movement of the impact force transmitting member.

6. The impact tool according to claim 1, wherein the passage has a crank shape in a cross section along a longitudinal direction of the cylinder member.

* * * * *